US005316455A

United States Patent [19]

Yoshimura et al.

[11] Patent Number: 5,316,455

[45] Date of Patent: May 31, 1994

[54] ROTARY COMPRESSOR WITH STABILIZED ROTOR

[75] Inventors: Takao Yoshimura, Kamakura; Ichiro Morita; Hideharu Ogahara, both of Fujisawa, all of Japan

[73] Assignee: Matsushita Refrigeration Company, Osaka, Japan

[21] Appl. No.: 969,815

[22] PCT Filed: May 30, 1991

[86] PCT No.: PCT/JP91/00725

§ 371 Date: Jan. 25, 1993

§ 102(e) Date: Jan. 25, 1993

[87] PCT Pub. No.: WO92/21881

PCT Pub. Date: Dec. 10, 1992

[30] Foreign Application Priority Data

| | | | |
|---|---|---|---|
| Mar. 20, 1990 | [JP] | Japan | 2-070467 |
| Mar. 20, 1990 | [JP] | Japan | 2-070479 |
| Oct. 25, 1991 | [JP] | Japan | 1-278874 |

[51] Int. Cl.[5] ..... F01C 1/02; F03C 2/00

[52] U.S. Cl. ..... 418/63; 418/76; 418/77; 418/94; 418/99

[58] Field of Search ..... 418/63, 75, 76, 77, 418/94, 97, 98, 99

[56] References Cited

U.S. PATENT DOCUMENTS

| | | | |
|---|---|---|---|
| 3,695,789 | 10/1972 | Jansson | 418/75 |

FOREIGN PATENT DOCUMENTS

| | | | |
|---|---|---|---|
| 54-71809 | 6/1979 | Japan . | |
| 56-106088 | 8/1981 | Japan . | |
| 0191488 | 11/1982 | Japan | 418/75 |
| 61-20317 | 6/1986 | Japan . | |
| 61-51678 | 11/1986 | Japan . | |
| 0009985 | 1/1990 | Japan | 418/63 |

*Primary Examiner*—Richard A. Bentsch
*Assistant Examiner*—Charles G. Freay
*Attorney, Agent, or Firm*—Stevens, Davis, Miller & Mosher

[57] ABSTRACT

The same number of grooves 20 through 27 are provided in end surfaces 19*a* and 19*b* of a roller 19. The grooves 20 through 27 have communicating portions 20*a* through 27*a* which communicate with an inner peripheral side of the roller 19 and sealed portions 20*b*, 20*c*, 20*d*, 20*e*, 20*f* through 27*b*, 27*c*, 27*d*, 27*e* and 27*f* each of whose cross-sectional area decreases. Accordingly, the cross-sectional area is decreased in direction in which a lubricating oil flows, and a plurality of oil pressures can thus be obtained. This results in a fixed clearance of roller 19.

5 Claims, 7 Drawing Sheets

ROTARY COMPRESSOR WITH STABILIZED ROTOR

TECHNICAL FIELD

The present invention relates to a rotary compressor which is for use in the refrigerating cycle of a refrigerator or freezer and which is provided with a compression mechanical portion having an excellent volumeric efficiency.

BACKGROUND ART

In recent years, there has been an increasing demand for a reduction in the size of a compressor for use in the refrigerating cycle. This is achieved by employing a rotary type compressor in place of a reciprocating type compressor.

However, the rotary compressor has a drawback in that the motion of a roller is unstable because the direction of the rotation thereof on its own axis changes during a single rotation thereof, deteriorating the volumeric efficiency thereof.

A conventional rotary compressor will be described below in detail with reference to FIGS. 1 through 4.

Reference numeral 1 denotes a sealed casing and 2 denotes an electric motor portion which is coupled, through a shaft 3, to a mechanical portion body 9 including a cylinder 4, a roller 5, a vane 6, a main bearing 7 and a sub bearing 8. The shaft 3 has a main shaft 3*a*, a sub shaft 3*b* and a crank 3*c* which is eccentric from the axis of the main and sub shafts 3*a* and 3*b* by E. The shaft 3 has a hole 3*e* at the center thereof, and the crank 3*c* has an oil supplying hole 3*f* and an oil supplying groove 3*g*. Reference numeral 10 denotes a spring provided on the rear surface of the vane, and 11*a* and 11*b* respectively denote a suction chamber and a compression chamber formed within the cylinder 4 by the roller 5, the vane 6 and the main and sub bearings 7 and 8. The inner peripheral sides of end surfaces 5*a* and 5*b* of the roller 5 which respectively face the main and sub bearings 7 and 8 are tapered to form tapered portions 5*c* and 5*d* whose cross-sectional area decreases toward the outer peripheral side thereof. Reference numeral 12 denotes an oil supplying mechanism coupled to the shaft 3. Reference numeral 13 denotes a suction pipe which communicates with the suction chamber 11*a* via a suction passage 14 formed in the sub bearing 8 and the cylinder 4. 15 denotes a discharge hole which communicates with the interior of the sealed casing via a discharge valve 16. 17 denotes a discharge pipe which is opened into the sealed casing 1. 18 denotes a lubricating oil.

In FIG. 4, the arrow of the solid line indicates the direction of the motion of the roller 5 which is obtained at a certain time during the operation of the compressor, and the arrow of the broken line indicates the direction in which the lubricating oil 18 flows over the end surfaces 5*a* and 5*b* of the roller as a consequence of the operation of the roller 5. Reference numeral 5*e* denotes a portion of the tapered portion 5*c* or 5*d* of the roller 5 whose cross-sectional area gradually decreases in the direction indicated by the arrow of the broken line, and 5*f* denotes a portion whose cross-sectional area gradually increases in the same direction.

The compression mechanism of the rotary compressor will now be described. A refrigerant gas supplied from a cooling system (not shown) passes through the suction pipe 13 and the suction hole 14, and then reaches the suction chamber 11*a* of the cylinder 4.

Thereafter, the refrigerant gas is gradually compressed by the rotary motion of the shaft 3 which is generated by the rotation of the electric motor portion 2 in the compression chamber 11*b* defined by the roller 5 rotatably supported by the crank 3*c* of the shaft 3 and the vane 6. The compressed refrigerant gas is discharged into the interior of the sealed casing 1 through the discharge hole 15 and the discharge valve 16, and then discharged into the cooling system through the discharge pipe 17.

The high-pressure lubricating oil 18 with the refrigerant contained therein and contained in the sealed casing 1 is supplied to the hole 3*e* of the shaft 3 by means of the oil supplying mechanism 12. Thereafter, the lubricating oil 18 is supplied to the sliding portion of the main and sub bearings 7 and 8 and to the crank 3*c* and the inner peripheral side of the roller 5 from the oil supplying hole 3*f* and the oil supplying groove 3*g* to lubricate the roller end surfaces 5*a* and 5*b*. Subsequently, the lubricating oil 18 passes through the suction chamber 11*a* and the compression chamber 11*b*, is discharged into the sealed casing 1 from the discharge hole 15, and then stays at the bottom of the sealed casing 1.

As the shaft 3 is rotated, the roller 5 rotates while turning round about the crank 3*c* in either of two directions. Consequently, the locus of a certain point on the roller 5 is spiral, and the direction of the movement of the roller 5 changes about 360° while the shaft 3 is rotated. Assuming that the direction of the spiral motion of the roller 5 is that indicated by the arrow in FIG. 4, since the tapered portions 5*c* and 5*d* are provided on the end surfaces 5*a* and 5*b* of the roller 5 and the cross-section of the portion 5*e* gradually decreases toward the outer diameter side of the roller, only the lubricating oil 18 which flows into the vicinity of the portion 5*e* in the tapered portion 5*c* or 5*e* generates an oil pressure due to the wedge effect. Consequently, the oil pressure near the tapered portion 5*c* balances the oil pressure near the tapered portion 5*d*, and the roller 5 is thus retained such that a clearance $\delta a$ between the roller 5 and the main bearing 7 is equal to a clearance $\delta b$ between the roller 5 and the sub bearing 8. The amount of lubricating oil with the refrigerant contained therein which flows into the suction chamber 11*a* and the compression chamber 11*b* from the crank 3*c* through the roller end surfaces 5*a* and 5*b* is proportional to the cube of the clearance. Therefore, where $\delta a+\delta b=\text{constant}$, the amount of lubricating oil which flows in is at a minimum when $\delta a=\delta b$. Thus, the provision of the tapered portions 5*c* and 5*d* assures a compressor exhibiting an excellent volumeric efficiency and hence a high efficiency.

Such a compressor is disclosed in, for example, Japanese Utility Model Publication No. 61-20317.

However, in a compressor which has the above-described structure and in which the thickness of the roller, indicated by (outer diameter - inner diameter)/2, is small and the ratio of the high pressure to the low pressure during operation (compression ratio) is high, as in the case of a small compressor for refrigeration having a small cubic capacity, even if the clearance between the end surface of the roller and the main bearing is made equal to the clearance between the end surface of the roller and the sub bearing by the provision of the tapered portions, the clearance of the tapered portion provided over the entire periphery practically increases by a value corresponding to the amount of taper, and the sealed distance of the flat surface where no tapered portion is provided decreases over the entire periphery, increasing the amount of lubricating oil with the refrigerant contained therein which flows into the suction chamber and the compression chamber. Thus, the provision of the tapered portion does not ensure reduction in the leakage loss and improvement in the volumeric efficiency.

The above-described structure utilizes the wedge effect of the lubricating oil which enters the tapered portion. This wedge effect is generated by the component of the roller rotation in the spiral motion thereof caused by the rotation of the shaft and not generated by the component of the roller rotation about the crank, because the cross-sectional area of the tapered portion remains the same in the circumferential direction, and is thus low. Furthermore, the oil pressure is generated by the wedge effect only at the single portion on the end surface of the roller, and no oil pressure is generated at most of the portion of the end surface. Furthermore, since the tapered portion has a shape which continues in the circumferential direction, the pressure generated by the wedge effect may escape in the circumferential direction, reducing the pressure generated by the wedge effect. Therefore, the stability of the roller achieved by the wedge effect is not sufficient, and the improvement in the volumeric efficiency is low.

DISCLOSURE OF INVENTION

A primary object of the present invention is to stabilize the motion of a roller and thereby improve the volumeric efficiency of the compressing mechanism portion.

A secondary object of the present invention is to minimize the amount of lubricating oil with a refrigerant contained therein which flows into a suction chamber and a compression chamber.

Practically, a groove, having a communicating portion which communicates with an inner peripheral side of a roller as well as a plurality of sealed portions which extend substantially in a circumferential direction and whose cross-sectional area decreases as a distance to the communicating portion increases, is provided in each of the end surfaces of the roller, which face a main bearing and a sub bearing.

Furthermore, a plurality of grooves, which communicate with an inner peripheral side of a roller and which face an end surface of the roller at least once during a single rotation of a shaft, are formed in a main bearing and a sub bearing which face the roller.

BEST MODE FOR CARRYING OUT THE INVENTION

Figure 1:
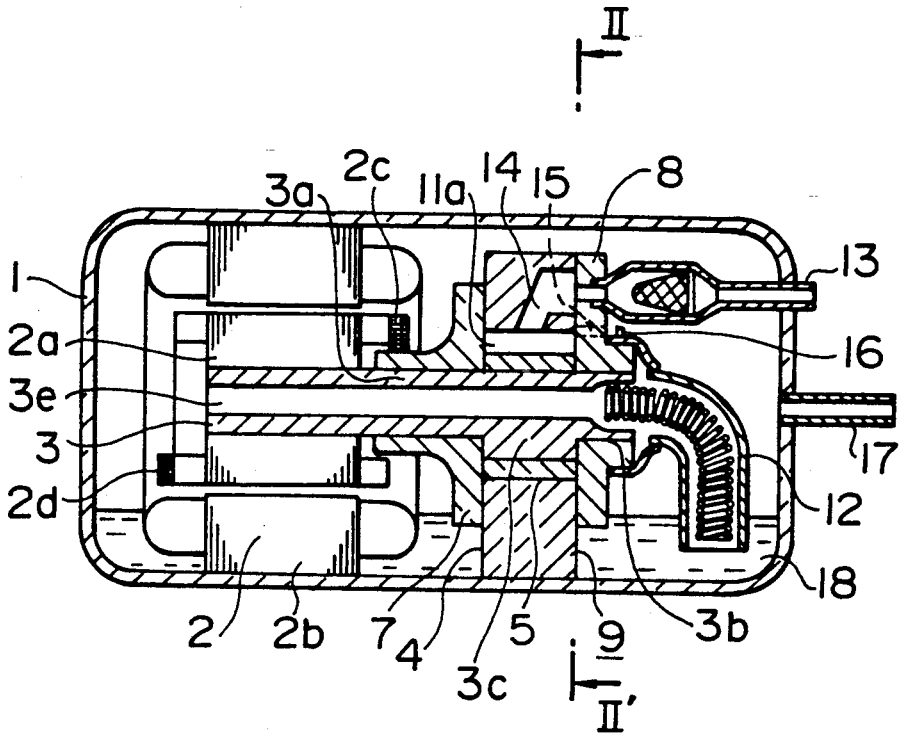
FIG. 1 PRIOR ART
FIG. 1 is a longitudinal cross-sectional view of a conventional rotary compressor.
Figure 2:
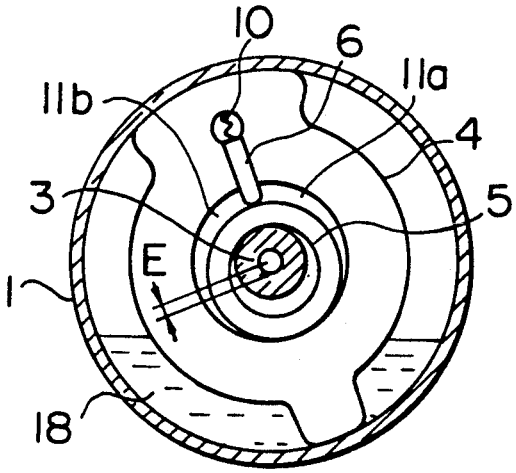
FIG. 2 PRIOR ART
FIG. 2 is a section taken along the line II—II' of FIG. 1.
Figure 3:
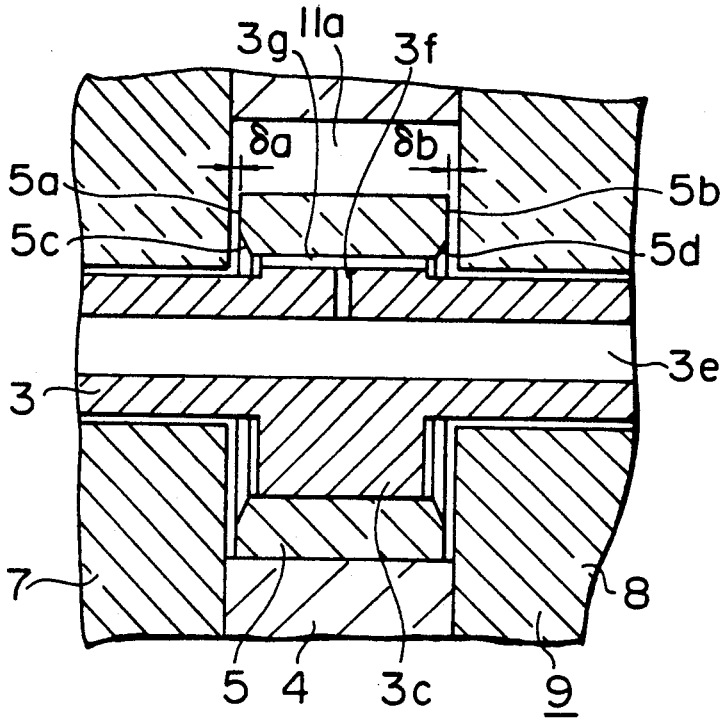
FIG.3 PRIOR ART
FIG. 3 is an enlarged cross-sectional view of a mechanical portion of FIG. 1.
Figure 4:
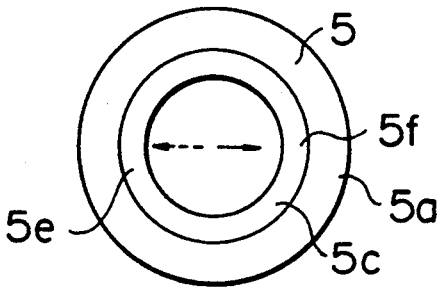
FIG.4 PRIOR ART
FIG. 4 is a front view of a roller of FIG. 1.

Embodiments of the present invention will now be described with reference to the accompanying drawings in which identical reference numerals to those in FIGS. 1 through 4 represent similar or identical elements and description thereof is omitted.

Figure 5:
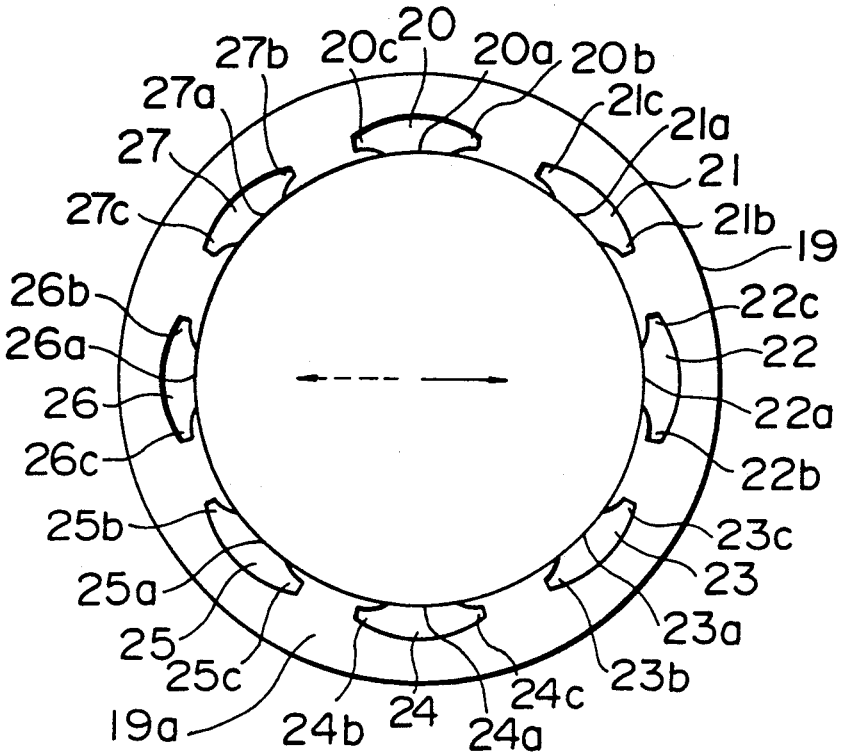
FIG. 5 is a front view of a roller of a rotary compressor showing a first embodiment of the present invention.
Figure 6:
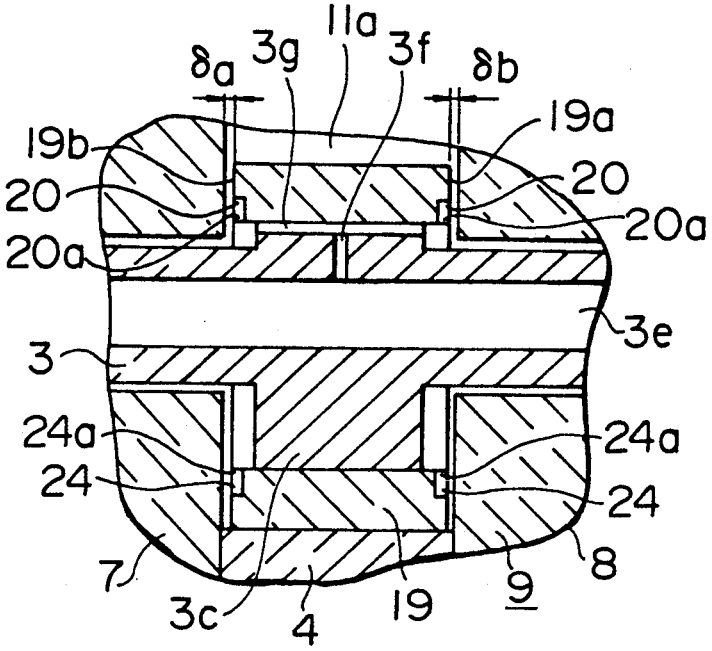
FIG. 6 is an enlarged cross-sectional view of a mechanical portion of FIG. 5.

FIGS. 5 and 6 illustrates a first embodiment of the present invention.

Reference numeral 19 denotes a roller which is rotatably retained by the crank 3*c* of the shaft 3, as in the case of the conventional compressor. The same number of grooves 20 through 27 are formed on end surfaces 19*a* and 19*b* of the roller 19. The grooves 20 through 27 are respectively formed by communicating portions 20*a* through 27*a* which communicate with the inner peripheral portion of the roller 19, and sealing portions 20*b* through 27*b* and 20*c* through 27*c* which extend from the communicating portions 20*a* through 27*a* in the circumferential direction and whose cross-sectional area decreases as a distance from the communicating portions 20*a* through 27*a* increases.

In such a structure, the refrigerant gas sucked from the suction pipe 13 is compressed and discharged to the cooling system from the discharge pipe 17 in the same manner as that of the conventional compressor.

The high-pressure lubricating oil 18 with the refrigerant contained therein which is contained in the sealed casing 1 lubricates the mechanical portion body 9 in the same manner as that of the conventional compressor. The lubricating oil 18 which flows into the inner peripheral side of the roller 19 lubricates the end surfaces 19*a* and 19*b*, and then returns to the bottom portion of the sealed casing in the same manner as that of the conventional compressor.

As the shaft 3 is rotated, the roller 19 revolves while turning round about the crank, as in the case of the conventional compressor. As a result, the roller 19 goes on the spiral motion. The direction of the spiral motion which is obtained at a certain instance is indicated by the arrow of the solid line, and the direction in which the lubricating oil 18 flows as a consequence of the motion of the roller 19 is indicated by the arrow of the broken line, as in the case of the conventional compressor.

At that time, in the grooves 20 through 27 formed on the end surface 19*a* of the roller 19, the sealed portions 20*c*, 21*c*, 23*b*, 24*b*, 25*b*, 26*b*, 26*c* and 27*c* in the sealed portions 20*b* through 27*b* and 20*c* through 27*c* reduce their cross-sectional area in the direction of flow of the lubricating oil 18 which is indicated by the arrow of the broken line, generating a pressure of the lubricating oil 18 which flows in from the communicating portions 20*a* through 27*a*.

That is, in the grooves 20 through 27 except for the groove 22, the oil pressure is generated at either of or both of the sealed portions 20*b* through 27*b* and 20*c* through 27*c*, and the positions where the oil pressure is generated are thus distributed over the end surface 19*a* of the roller 19, unlike the conventional compressor in which the oil pressure is generated at only a single position. In addition, generation of the oil pressure occurs in the grooves 20 through 27 formed on the end surface 19*b* in the same manner as that for the grooves 20 through 27 formed on the end surface 19*a*; that is in all the grooves except for the groove 22 located at a position symmetrical with respect to the position of the groove 22 formed on the end surface 19*a*, the oil pressure is generated at either or both of the sealed portions 20*b* through 27*b* and 20*c* through 27*c*, and the positions on the end surface 19*b* where the oil pressure is generated are symmetrical with respect to the positions on the end surface 19*a* where the oil pressure is generated.

Regarding the component of the roller rotation about the crank which forms the spiral motion of the roller 19, since the sealed portions 20*b* through 27*b* and 20*c* trough 27*c* are formed in such a manner that the cross-sectional area thereof decreases substantially in the circumferential direction, the oil pressure, due to the wedge effect is generated in the sealed portions, regardless of the direction in which the roller 19 is rotated about the crank. Furthermore, since the oil pressure is generated near the sealed portions 20*b* through 27*b* and 20*c* through 20*c*, it cannot escape from the sealed portions, and the oil pressure is thus increased. Therefore, the same amount of oil pressure is generated on the end surfaces 19*a* and 19*b* of the roller 19 over the distributed positions, and the generated oil pressures thus balance. In addition, since the generated oil pressure is higher than the conventionally generated oil pressure because of an increase in the oil pressure generated by the component of the roller rotation about the crank and the incapability of escape of the generated oil pressure, the roller 19 can be retained at a position which ensures $\delta a = \delta b$ during one rotation more reliably than the conventional roller can be, and the volumeric efficiency of the compressor can thus be improved.

Furthermore, since the grooves 20 through 27 are not provided over the entire periphery, the sealed distance is longer than that obtained when the tapered portions are provided. Thus, the amount of lubricating oil which flows into the compression chamber and the suction chamber is reduced, and this makes improvement in the volumeric efficiency possible even int he case of a small compressor in which the thickness of the roller is small.

Figure 7:
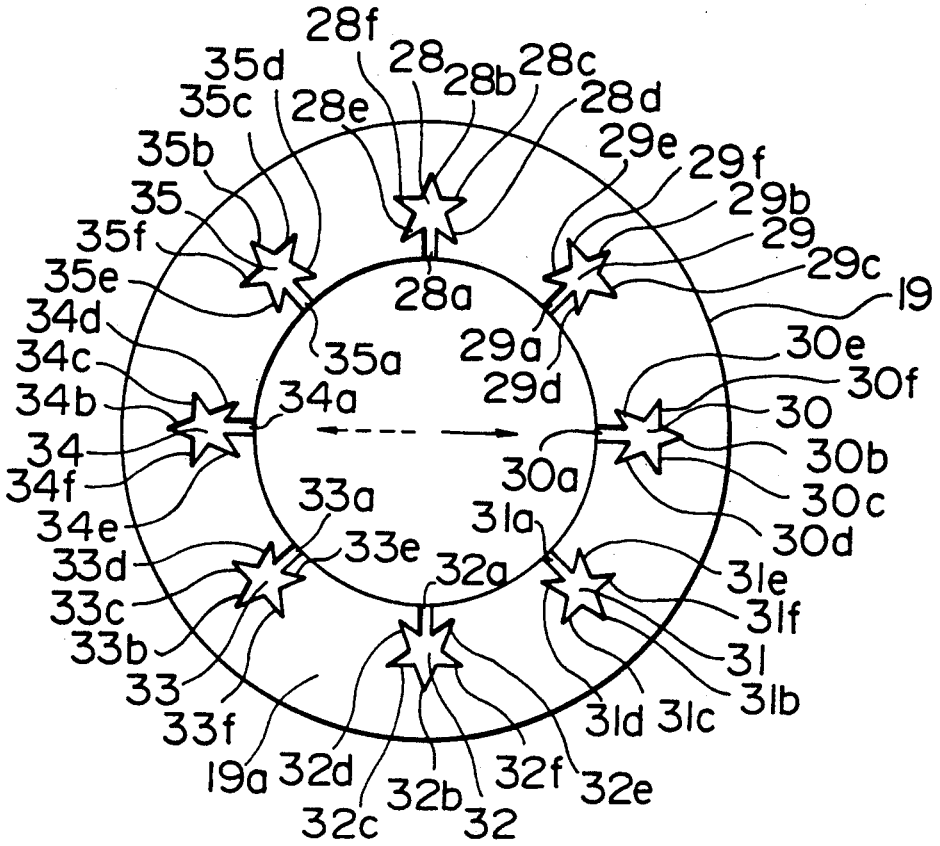
FIG. 7 is a front view of a roller of a rotary compressor showing a second embodiment of the present invention.
Figure 8:
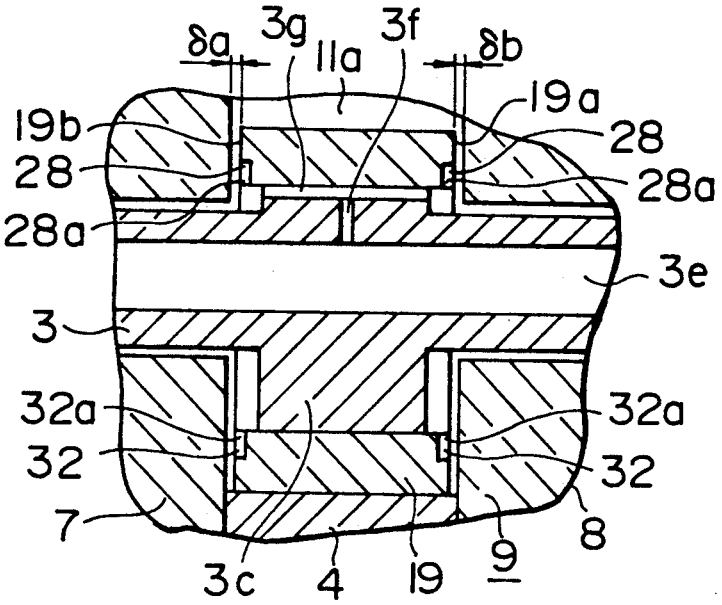
FIG. 8 is an enlarged cross-sectional view of a mechanical portion of FIG. 7.

A second embodiment of the present invention will be described below with reference to FIGS. 7 and 8. In the following description, only the differences between the first and second embodiments will be explained.

The same number of grooves 28 through 35 are formed on the end surfaces 19*a* and 19*b* of the roller 19. The grooves 28 through 35 are respectively formed by communicating portions 28*a* through 35*a* which communicate with the inner peripheral portion of the roller 19, and sealing portions 28*b* through 35*b*, 28*c* through 35*c*, 28*d* through 35*d*, 28*e* through 35*e* and 28*f* through 35*f* which extend from the communicating portions 28*a* through 35*a* substantially radially and whose cross-sectional area decreases as a distance from the communicating portions 28*a* through 35*a* increases.

In such a structure, the refrigerant gas sucked from the suction pipe 13 is compressed and discharged to the cooling system form the discharge pipe 17 in the same manner as that of the conventional compressor.

The high-pressure lubricating oil 18 with the refrigerant contained therein which is contained in the sealed casing 1 lubricates the mechanical portion body 9 in the same manner as that of the convention compressor. The lubricating oil 18 which flows into the inner peripheral side of the roller 19 lubricates the end surfaces 19*a* and 19*b* and then returns to the bottom portion of the sealed casing in the same manner as that of the conventional compressor.

As the shaft 3 is rotated, the roller 19 revolves while rotating about the crank, as in the case of the conventional compressor. As a result, the roller 19 performs the spiral motion. The direction of the spiral motion which is obtained at a certain instance is indicated by the arrow with the solid line, and the direction in which the lubricating oil 18 flows as a consequence of the motion of the roller 19 is indicated by the arrow with the broken line, as in the case of the conventional compressor.

At that time, in the grooves 28 through 35 formed on the end surface 19*a* of the roller 19, a pressure of the lubricating oil 18 which flows in from the communicating portions 28*a* through 35*a* is generated at the sealed portions whose cross-sectional area decreases in the direction of flow of the lubricating oil 18, which is indicated by the arrow with the broken line, from among the sealed portions 28*b* through 35*b*, 28*c* through 35*c*, 28*d* through 35*d*, 28*e* through 35*e* and 28*f* through 35*f*. In the groove 28, for example, an oil pressure is generated at the sealed portions 28*e* and 28*f*. In the groove 32, an oil pressure is generated at the sealed portions 32*c* and 32*d*. That is, in all the grooves 28 through 35, the oil pressure is generated at two portions, and the positions where the oil pressure is generated are thus distributed over the end surface 19*a* of the roller 19, unlike the conventional compressor in which the oil pressure is generated at only a single position. In addition, generation of the oil pressure occurs on the end surface 19*b* in the same manner as that for the end surface 19*a*. Therefore, the positions on the end surface 19*b* where the oil pressure is generated are symmetrical with respect to the positions on the end surface 19*a* where the oil pressure is generated, and the oil pressures generated on the end surfaces 19*a* and 19*b* thus balance with each other.

Regarding the component of the roller rotation about the crank which forms the spiral motion of the roller 19, since the sealed portions 28*c* through 35*c*, 28*d* through 35*d*, 28*e* through 35*e* and 28*f* through 35*f* are formed in such a manner that the cross-sectional area thereof decreases substantially in the circumferential direction, the oil pressure due to the wedge effect is generated in these sealed portions, regardless of the direction in which the roller 19 is rotated about the crank. Furthermore, since the oil pressure is generated near the sealed portions 28*b* through 35*b*, 28*c* through 35*c*, 28*d* through 35*d*, 28*e* through 35*e* and 28*f* through 35*f*, it cannot escape from the sealed portions, and the oil pressure is retained high. Therefore, the same amount of oil pressure is generated on the end surfaces 19*a* and 19*b* of the roller 19 over the distributed positions, and the generated oil pressures thus balance. In addition, since the generated oil pressure is higher than the conventionally generated oil pressure because of an increase in the number of positions where the oil pressure is generated, an increase in the amount of oil pressure generated by the component of the roller rotation about the crank and the incapability of escape of the generated oil pressure, the roller 19 can be retained at a position which ensures $\delta a = \delta b$ during one rotation more reliably than the conventional roller can be, and the volumeric efficiency of the compressor can thus be improved while the leakage loss can be reduced.

Furthermore, since the grooves 28 through 35 are not provided over the entire periphery, the sealed distance is longer than that obtained when the tapered portions are provided. Thus, the amount of lubricating oil which flows into the compression chamber and the suction chamber is reduced, and this reduction makes an improvement in the volumeric efficiency possible even in the case of a small compressor in which the thickness of the roller is small.

Figure 9:
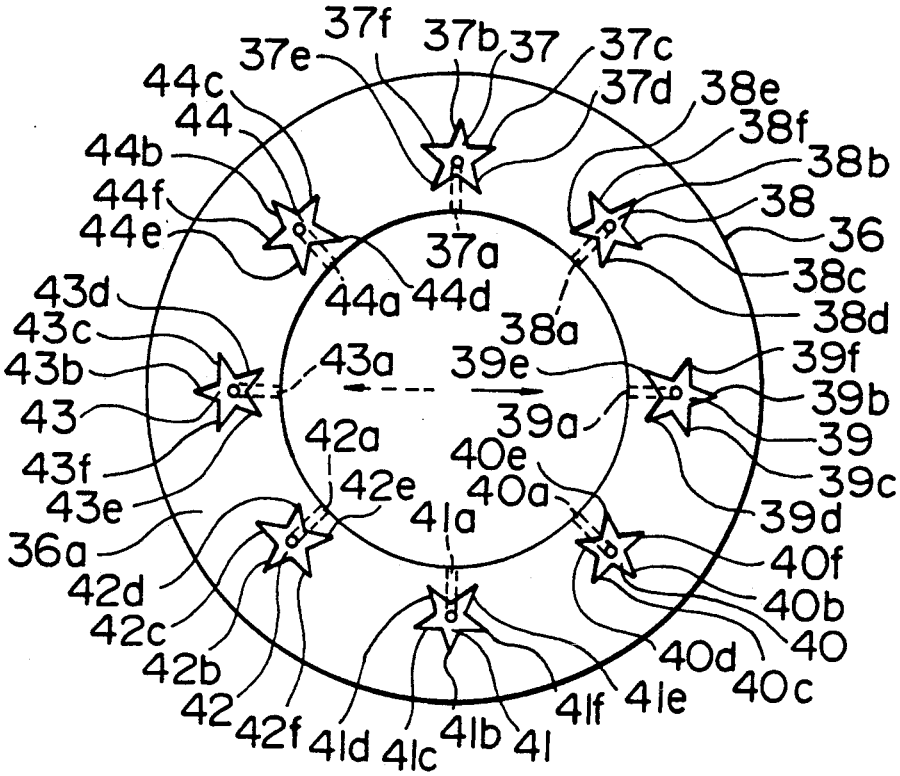
FIG. 9 is a front view of a roller of a rotary compressor showing a third embodiment of the present invention.
Figure 10:
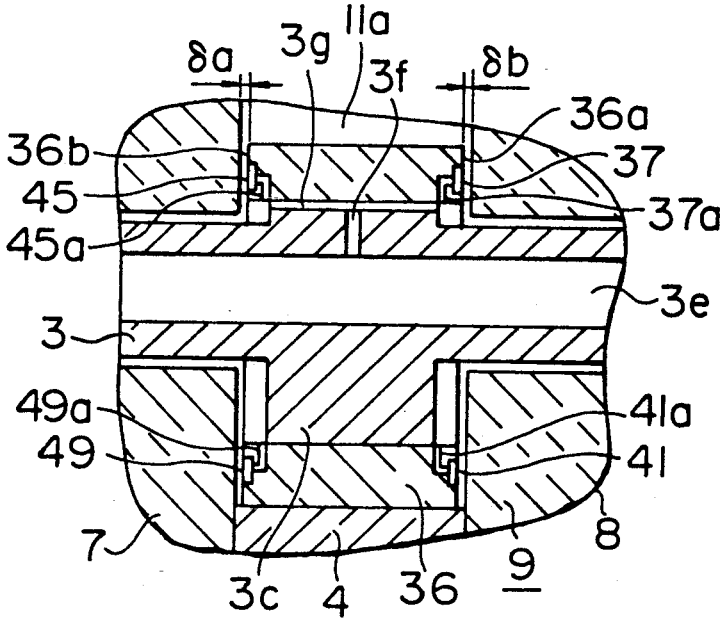
FIG. 10 is an enlarged cross-sectional view of a mechanical portion of FIG. 9.

A third embodiment of the present invention will be described below with reference to FIGS. 9 and 10.

Grooves 37 through 44 are formed in each of the end surfaces 36*a* and 36*b* of the roller 36. In the grooves 37 through 44, communicating portions 37*a* through 44*a* are formed in such a manner that they pass the inner peripheral portion of the roller 36 and the grooves 37 through 44, and sealed portions 37*b* through 44*b*, 37*c* through 44*c*, 37*d* through 44*d*, 37*e* through 44*e* and 37*f* through 44*f* are formed radially from portions of the communicating portions 37*a* through 44*a* which open into the grooves 37 through 44. In this embodiment, an oil pressure is generated from to the spiral motion of the roller at the sealed portions 37*b* through 44*f*, as in the cases of the previously described embodiments. At that time, since the communicating portions 37*a* through 44*a* are opened into the central portions of the grooves 37 through 44, and the distance from the communicating is generated, and the oil pressure generated on the portions 37*a* through 44*a* to all the sealed portions 37*b* through 44*f* is hence the same, an oil pressure is generated under the same conditions. Therefore, a higher oil pressure than that generated in the second embodiment can be generated, and the lubricating oil can be supplied smoothly.

A fourth embodiment of the present invention will be described below with reference to FIGS. 11 through 14.

Reference numerals 45 and 46 respectively denote a main bearing and a sub bearing which rotatably support the shaft 3 in the same manner as that of the conventional compressor. Reference numeral 47 designates a roller which is rotatably retained on the crank 3*c* of the shaft 3. The same number of grooves 48 through 55 are formed in the main and sub bearings 45 and 46. Each of the grooves 48 through 55 has a shape in which the cross-sectional area thereof is the largest at the center thereof and decreases in the circumferential and radial directions.

Figure 11:
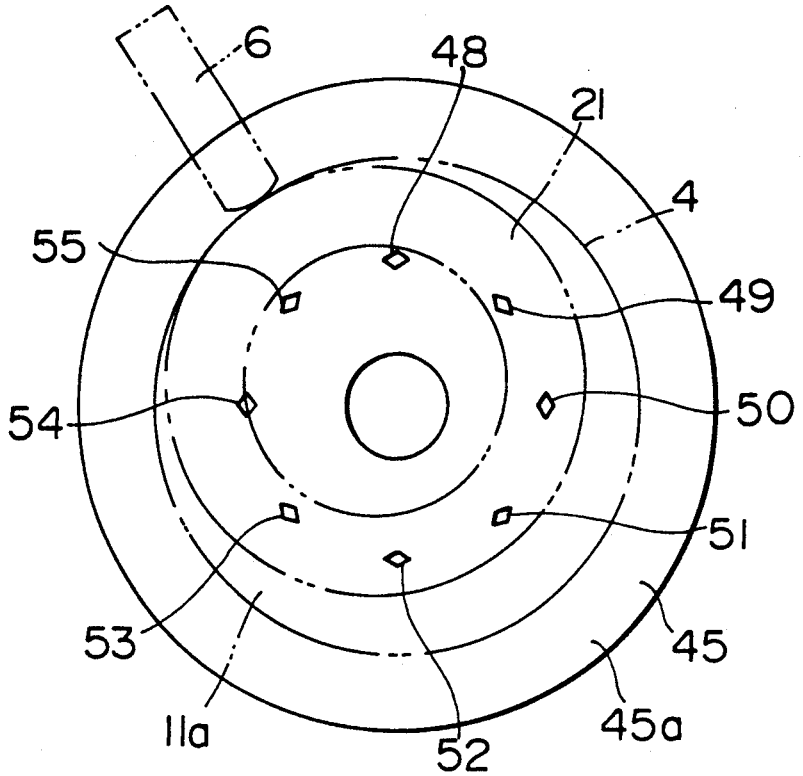
FIG. 11 is a front view of a roller of a rotary compressor showing a fourth embodiment of the present invention.
Figure 12:
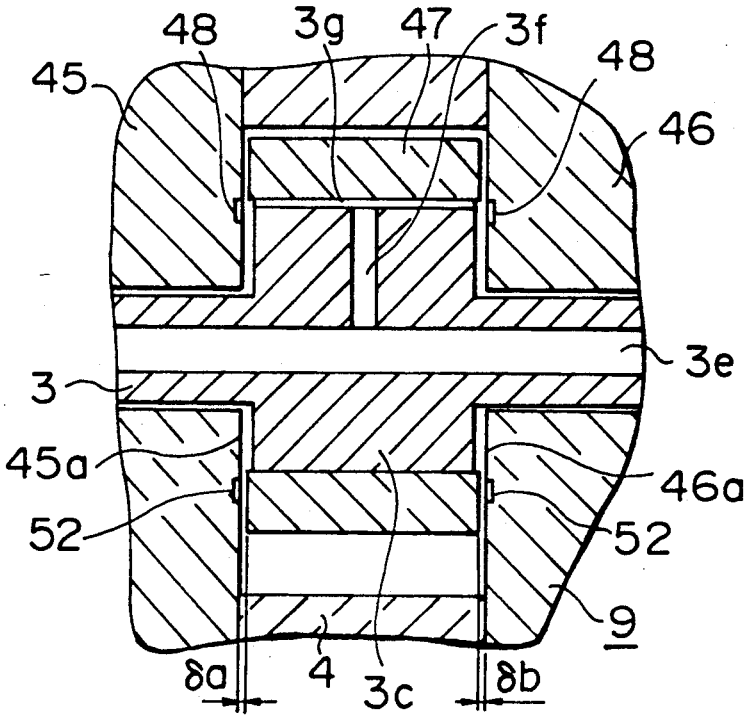
FIG. 12 is an enlarged cross-sectional view of a mechanical portion of FIG. 11.

In FIG. 11, dot-dot-dashed lines indicate the inner peripheral surface of the cylinder 4, the vane 6 and the roller 47. FIG. 11 shows the positional relation between the grooves 48 through 55 and the roller 47 which is obtained at a certain rotational position.

Figure 13:
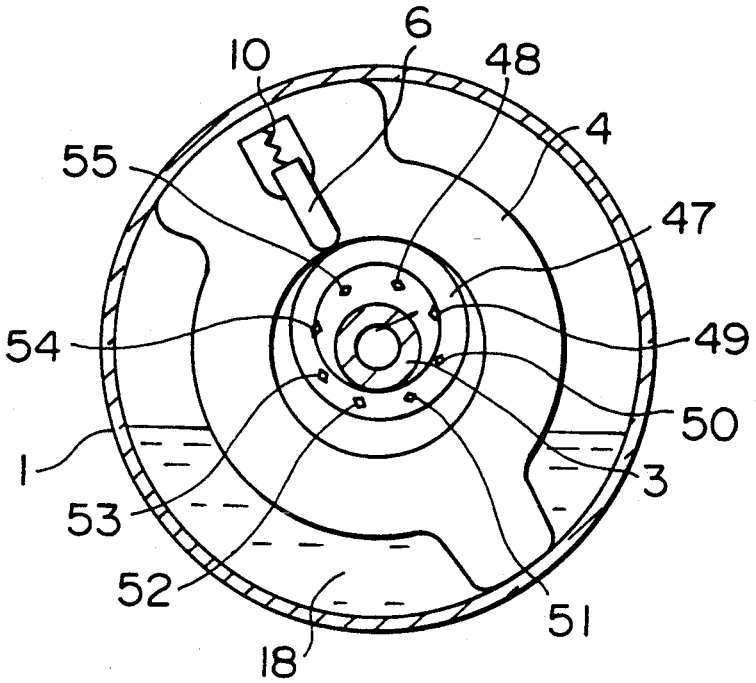
FIGS. 13 and 14 are cross-sectional views showing the operation of the mechanical portion of FIG. 11.
Figure 14:
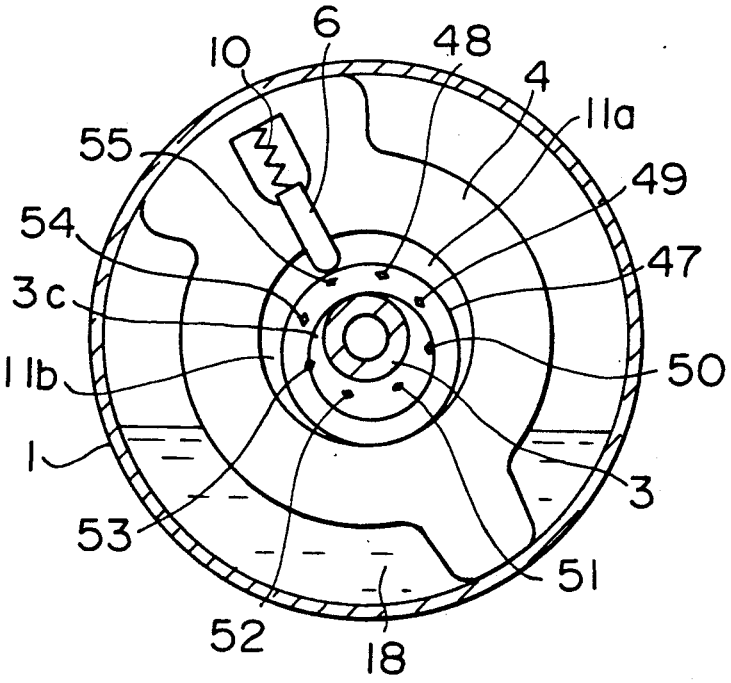

FIGS. 13 and 14 show the positional relation between the grooves 48 through 55 and the roller 47. In these figures, although the grooves 48 through 55 should have a hidden outline, they are indicated by the solid line for the ease of understanding.

In such a structure, the refrigerant gas sucked from the suction pipe 13 is compressed and discharged to the cooling system from the discharge pipe 17 in the same manner as that of the conventional compressor.

The high-pressure lubricating oil 18 with the refrigerant contained therein which is contained in the sealed casing 1 lubricates the mechanical portion body 9 in the same manner as that of the conventional compressor. The lubricating oil 18 which flows into the inner peripheral side of the roller 19 lubricates the rollers 19*a* and 19*b* and then returns to the bottom portion of the sealed casing in the same manner as that of the conventional compressor.

As the shaft 3 is rotated, the roller 47 revolves while rotating about the crank, as in the case of the conventional compressor. The direction of the spiral motion which is obtained at a certain rotational angle is indicated by the arrow with the solid line in FIG. 13, as in the case of the conventional compressor.

At that time, the grooves 50, 51, 52 and 53 from among the grooves 48 through 55 of the main bearing 45 are sealed by the end surface of the roller 47. The grooves 48 through 55 of the sub bearing 46 are also sealed similarly. Since the grooves 48 through 55 have a shape in which the cross-sectional area thereof is the largest at the central portion thereof and decreases in the radial and circumferential directions, when the lubricating oil moves within the sealed grooves 50 through 53 in the direction indicated by the solid line, an oil pressure is generated in the grooves 50 through 53. In addition, the positions where the oil pressure is generated in the grooves 50 through 53 are symmetrical. That is, in this embodiment, the oil pressure is generated on each of the two end surfaces of the roller 47 at four positions, and the oil pressure generated on one of the end surfaces balances the oil pressure generated on the other end surface.

Regarding the component of the roller rotation about the crank which forms the spiral motion thereof, since the grooves 48 and 55 are formed in such a manner that the cross-sectional area thereof decreases in the circumferential direction, the oil pressure is generated in the sealed grooves 50 through 53 due the wedge effect, regardless of the direction in which the roller rotates about the crank. In addition, since the grooves 48 through 55 are formed separately, the oil pressure generated in the sealed grooves 50 through 53 cannot escape from the sealed grooves, and the oil pressure is thus retained high.

Furthermore, as shown in FIG. 14, when the shaft 3 is rotated to another rotational position, the grooves 48, 49, 50 and 51 are now sealed by the end surface of the roller 47, and an oil pressure is generated in each of these grooves. Thus, whichever of the rotational positions the shaft 3 is rotated, some of the grooves 48 through 55 are sealed.

Therefore, the same amount of oil pressure is generated on each of the end surfaces of the roller 47 over the distributed positions, and the generated oil pressures thus balance. In addition, since the generated oil pressure is higher than the conventionally generated oil pressure because of an increase in the amount of oil pressure generated by the component of the roller rotation about the crank and the incapability of escape of the generated oil pressure, the roller 47 can be retained at a position which ensures $\delta a = \delta b$ during one rotation more reliably than the conventional roller can be, and the volumeric efficiency of the compressor can thus be improved while the power loss due to leakage can be reduced.

Furthermore, since at any given time the roller 47 faces only some of the grooves 48 through 55, the sealed distance is longer than that obtained when the tapered portion is provided. Consequently, the amount of lubricating oil which flows into the compression chamber is reduced, and this makes an improvement in the volumeric efficiency possible even in the case of a compressor in which the thickness of the roller is small.

Industrial Applicability

As will be understood from the foregoing description, since the sealed portions of the lubricating oil and the communicating portions which communicate with the inner peripheral surface of the roller are formed in the contact surfaces between the roller and the main and sub bearings, the same amount of oil pressure can be generated over the distributed positions, and the generated oil pressures thus balance. Thus, if the rotary compressor is employed in a refrigerating cycle which is for use in, for example, a refrigerator or a freezer, the performance of the refrigerating cycle can be improved because the motion of the roller is stabilized, and the volumeric efficiency is thus improved.

What is claimed is:

1. A rotary compressor comprising: a cylinder; a main bearing and a sub bearing which are fixed to end surfaces of said cylinder; a shaft which is rotatable within said main bearing and said sub bearing and has a crank; a roller rotatably accommodated on said crank of said shaft and having end surfaces which face said main bearing and said sub bearing; a vane which makes contact with said roller and reciprocatively slides within a slot provided in said cylinder; and a groove provided in each of said end surfaces of said roller which respectively face said main bearing and said sub bearing, said groove provided in each of said end surfaces having a communicating portion for communicating with an inner peripheral side of said roller and a plurality of sealed portions which extend from said communicating portion, each f said plurality of sealed portions having a cross-sectional area which decreases as a distance from said communicating portion increases.

2. A rotary compressor according to claim 1, wherein said sealed portions extend substantially in a circumferential directions from said communicating portion.

3. A rotary compressor according to claim 1, wherein said sealed portions extend substantially in a radial direction from said communicating portion.

4. A rotary compressor comprising: a cylinder; a main bearing and a sub bearing which are fixed to end surfaces of said cylinder; a shaft which is rotatable within said main bearing and said sub bearing and has a crank; a roller rotatably accommodated on said crank of said shaft; a vane which makes contact with said roller and reciprocatively slides within a slot provided in said cylinder; and a plurality of grooves separately provided in an end surface of each of said main bearing and said sub bearing, each of said plurality of grooves (i) having a cross-sectional area which decreases in radial and circumferential directions and (ii) facing an end surface of said roller at least once during a single rotation of said shaft.

5. A rotary compressor according to claim 4, wherein each of said plurality of grooves has a central portion and wherein said cross-sectional area decreases in said radial and circumferential directions from said central portion.

* * * * *